US006439881B2

(12) United States Patent
Haynes et al.

(10) Patent No.: US 6,439,881 B2
(45) Date of Patent: Aug. 27, 2002

(54) SPIRAL-SHAPED ATMOSPHERIC GAS BURNER

(75) Inventors: Joel Meier Haynes, Niskayuna, NY (US); Victor Caloca; Jeronimo Ramirez, both of Querétaro (MX)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/535,796

(22) Filed: Mar. 28, 2000

(51) Int. Cl.[7] ..... F23D 14/10; F23D 14/46; F23D 14/84

(52) U.S. Cl. ..... 431/354; 431/278; 431/284; 431/285

(58) Field of Search ..... 431/278, 354, 431/10, 284, 285; 126/39 R, 39 E, 41 R, 40; 239/559, 553, 553.5, 554, 555, 567, 552

(56) References Cited

U.S. PATENT DOCUMENTS

| | | | | | |
|---|---|---|---|---|---|
| 355,314 | A | * | 1/1887 | Goodyear et al. | 122/134 |
| 737,676 | A | * | 9/1903 | Swartz | 122/115 |
| 1,542,241 | A | * | 6/1925 | Hartman | 126/92 B |
| 1,716,329 | A | * | 6/1929 | Simpson | |
| 1,971,449 | A | * | 8/1934 | Harper | 126/39 H |
| 2,041,706 | A | * | 5/1936 | Hahn | 239/557 |
| 2,257,399 | A | * | 9/1941 | Parker | |
| 2,344,144 | A | * | 3/1944 | Hobson | 431/286 |
| 3,027,888 | A | * | 4/1962 | Du Fault et al. | |
| 3,517,887 | A | * | 6/1970 | Desty | 239/568 |
| 3,606,612 | A | * | 9/1971 | Reid, Jr. et al. | 431/284 |
| 5,488,942 | A | | 2/1996 | Maughan | 126/39 E |
| 5,899,681 | A | | 5/1999 | Maughan | 431/8 |

FOREIGN PATENT DOCUMENTS

| | | | | |
|---|---|---|---|---|
| CA | 721584 | * | 11/1965 | 239/566 |
| DE | 528629 | * | 6/1931 | 126/40 |

* cited by examiner

*Primary Examiner*—Carl D. Price
(74) *Attorney, Agent, or Firm*—Patrick K. Patnode; Christian G. Cabou

(57) ABSTRACT

Improved burner performance is achieved by providing an atmospheric gas burner with a spiral-shaped burner body. A plurality of ports is formed in the burner body so as to be in fluid communication with the burner's internal chamber. Preferably, the burner body includes a substantially cylindrical hub section and an arm section that is joined at one end to the hub section and bends around the hub section.

5 Claims, 4 Drawing Sheets

SPIRAL-SHAPED ATMOSPHERIC GAS BURNER

BACKGROUND OF THE INVENTION

This invention relates generally to atmospheric gas burners and more particularly to such burners used in domestic cooking appliances.

Atmospheric gas burners are commonly used as surface units in household gas cooking appliances. Conventional gas burners ordinarily comprise a cylindrical head having a number of ports formed around its outer circumference. A mixer tube introduces a mixture of fuel and air into the burner head. The fuel-air mixture is discharged through the ports and ignited to produce a flame.

A significant factor in the performance of gas burners in general is the distribution of heat transferred from the burner to the cooking utensil, wherein an even heat distribution over the bottom of the utensil is desired. However, because the flame ports are disposed about the outer circumference of the cylindrical burner head, they are arranged in a circular pattern. All of the ports are thus located substantially equidistant from the center of the utensil, which means that heat is generally not evenly distributed along the radius of the utensil.

A more sensitive performance factor is the burner heating speed, which is typically measured as the time required to bring a standard cooking utensil of water to boil. Locating the burner ports close to the center of the utensil facilitates a higher thermal efficiency where there is adequate secondary air and therefore (for a specified gas input rate) a faster boiling time. Thus, heating speed can be enhanced by providing the burner head with a relatively small diameter so that the ports are arranged in a tight circle close to the center of the utensil. However, a smaller diameter burner head has greater restrictions on the amount of secondary combustion air available to the ports, leading to incomplete heat release at the ports and emissions of carbon monoxide.

One known approach for providing more even heat distribution and improved heating speed is a dual ring burner, which incorporates two separate burner bodies having individual fuel inputs. Such burners have a central burner body, which is much like a smaller version of a standard cylindrical burner head, encircled by a separate annular burner body having a larger diameter. However, the central burner body typically does not experience as much external air flow because it is completely surrounded by the outer burner body. Thus, less secondary combustion air is available, and the heat output of the central burner is limited. Other drawbacks of such "dual ring" burners are that they are more difficult to clean and are generally more costly than single body burners.

Accordingly, there is a need for a single body atmospheric gas burner that provides both an even heat distribution and an improved heating speed.

SUMMARY OF THE INVENTION

The above-mentioned need is met by the present invention which provides a gas burner having a spiral-shaped burner body defining an internal chamber. A plurality of ports is formed in the burner body so as to be in fluid communication with the internal chamber. Preferably, the burner body includes a substantially cylindrical hub section and an arm section that is joined at one end to the hub section and bends around the hub section.

The present invention and its advantages over the prior art will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
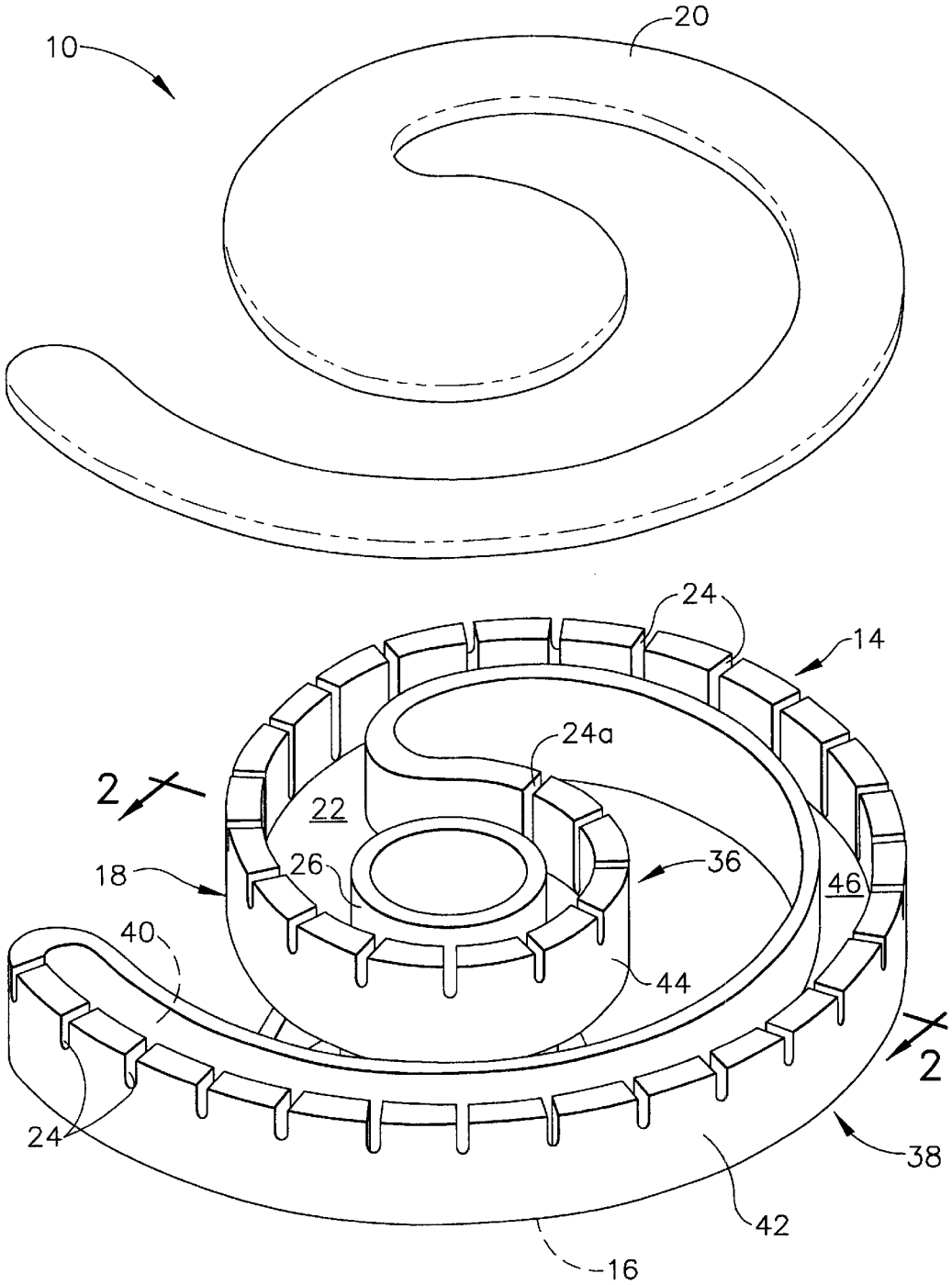
FIG. 1 is an exploded perspective view of an atmospheric gas burner of the present invention.
Figure 2:
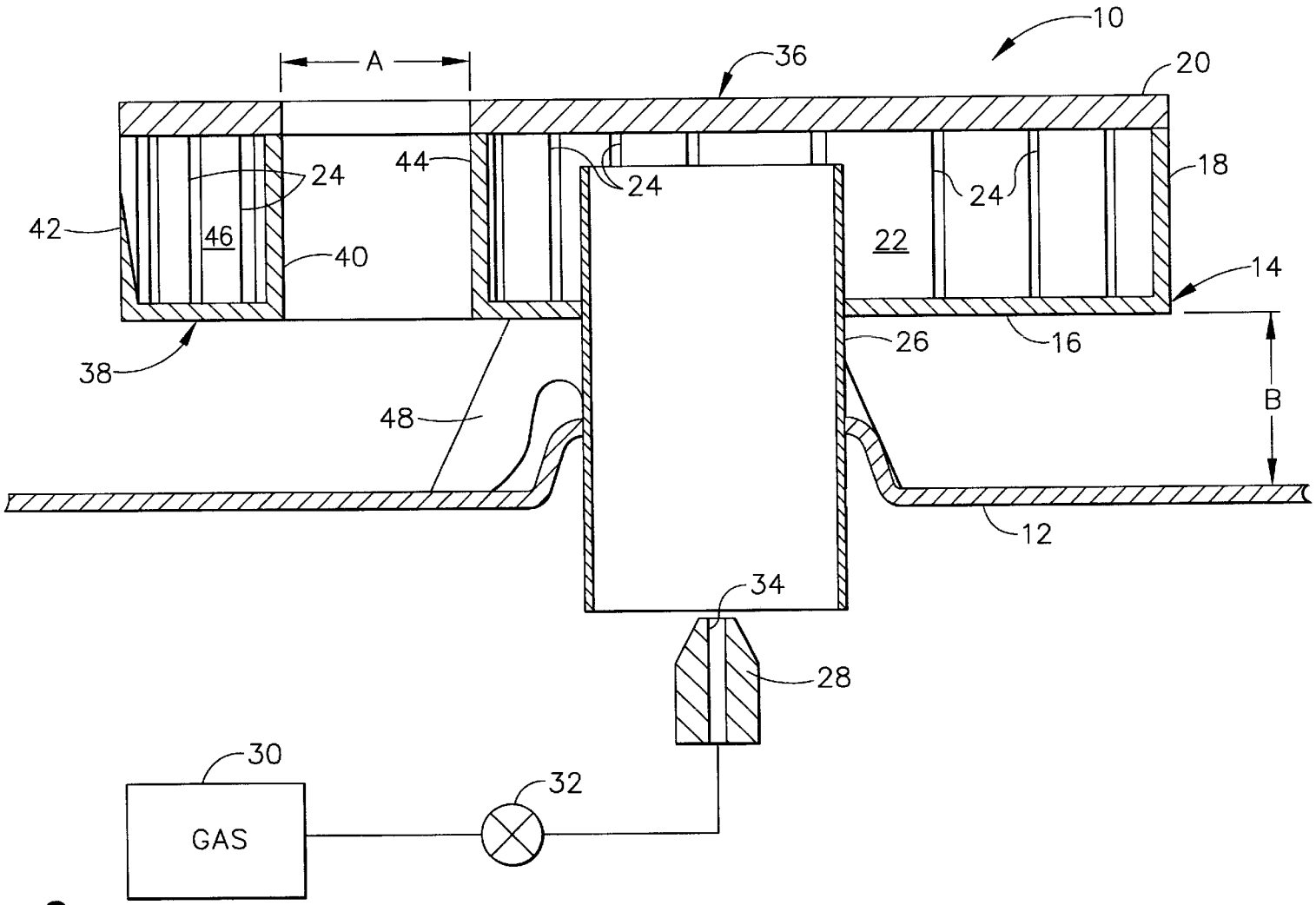
FIG. 2 is a cross-sectional plan view of the gas burner taken along line 2—2 of FIG. 1.

Referring to the drawings wherein identical reference numerals denote the same elements throughout the various views, FIGS. 1 and 2 show an atmospheric gas burner 10 of the present invention. The gas burner 10 is mounted on a support surface 12 that forms a portion of the top side of a gas cooking appliance such as a range or cooktop. As best shown in FIG. 2, the gas burner 10 is arranged as a so-called sealed burner. This means that there is no open space in the support surface 12 around the burner 10. The area beneath the support surface is thus sealed off to prevent spills from entering, thereby facilitating cleaning of the cooking surface. However, it should be understood that the present invention is not limited to use in sealed burner appliances, but is equally applicable to other types of gas cooking appliances.

The gas burner 10 comprises a spiral-shaped burner body 14 having a spiral-shaped base portion 16 and a sidewall 18 formed along the periphery of the base portion 16 and extending perpendicularly therefrom. The burner body 14 may be formed using any process, such as casting, forging, milling and the like. Furthermore, the burner body 14 can be made of any suitable material, such as aluminum, that is capable of accommodating the types of mechanical stresses, temperatures, and other operating conditions to which the gas burner 10 will be exposed. A spiral-shaped cap 20 covers the top of the burner body 14, thereby defining an internal fuel chamber 22 within the burner body 14. The cap 20 can either be rigidly attached to the sidewall 18 or can simply rest on the sidewall 18 for easy removal.

A plurality of burner ports 24 is formed in the outer edge of the sidewall 18 so as to be in fluid communication with the fuel chamber 22. As used herein, the term "port" refers to an aperture of any shape from which a flame can be supported. As will be discussed in more detail below, the burner ports 24 are primarily distributed over the outermost portion of the spiral-shaped sidewall 18 and are preferably, although not necessarily, evenly spaced. Generally, the total number of burner ports 24 will be in the range of about 20–40, depending on the size and heating requirements of the gas burner 10.

Although not shown in the drawings, the burner body 14 can also include a plurality of carry over slots, also known as secondary ports, formed in the outer edge of the sidewall 18. The carry over slots are relatively shallow slots formed between adjacent ones of the ports 24 to improve the flame retention and stability of the burner 10. These carry over slots are described in more detail in U.S. Pat. No. 5,899,681, issued May 4, 1999 to James R. Maughan.

A mixing tube 26, such as a venturi tube, extends through the support surface 12 and the base portion 16 so as to have a first end located in the fuel chamber 22 and a second end located externally of the burner body 14 and below the support surface 12. The gas burner 10 includes a fuel nozzle 28 connected to a source of gas 30 via a valve 32 (each shown schematically in FIG. 2). The valve 32 is controlled in a known manner by a corresponding control knob on the gas cooking appliance to regulate the flow of gas from the source 30 to the fuel nozzle 28. The fuel nozzle 28 is located approximately concentric with the opening of the mixing tube 26 and has an injection orifice 34 aligned with the second end of the mixing tube 26 so that fuel discharged from the injection orifice 34 flows into the mixing tube 26. Primary air to support combustion is obtained from the ambient space below the support surface 12 and is entrained by the fuel jet in conventional fashion through the open area around the second end of the mixing tube 26. Thus, the mixing tube 26 introduces a fuel-air mixture into the fuel chamber 22. The fuel-air mixture is discharged through the burner ports 24 for combustion. The combustion is further supported by the addition of secondary combustion air drawn from the ambient space around the burner ports 24.

The spiral-shaped burner body 14 is made up of a central hub section 36 and a curved arm section 38 contiguously formed with the hub section 36. The hub section 36 defines a substantially cylindrical shape having a diameter that is smaller than the typical diameter of the cylindrical head in a conventional gas burner. The first end of the mixing tube 26 is disposed in the hub section 36, preferably centered therein. The curved arm section 38 is joined at one end to the hub section 36 and bends around the hub section 36 in a substantially spiral manner so that its distal end is located a maximum distance from the center of the burner 10. Preferably, the curved arm section 38 is shaped so that a substantial portion of the arm section 38 is at the maximum distance from the burner center and is spaced a distance A (FIG. 2) from the hub section 36. This maximum distance is greater than the typical radius of the cylindrical head in a conventional gas burner. Preferably, the curved arm section 38 extends over an arc of approximately 270–320 degrees, although the arc could be less or more than this range. Indeed the curved arm section 38 could comprise multiple turns around the hub section 36.

The two sections 36 and 38 are joined together to form the burner body 14, which is a contiguous, single body. And while the sidewall 18 is a contiguous wall formed around the periphery of the base portion 16, it is made up of three portions: an inner curved wall portion 40 and an outer curved wall portion 42 in the arm section 38 and a substantially cylindrical wall portion 44 in the hub section 36. The inner curved wall portion 40 and the outer curved wall portion 42 are spaced apart to define a channel 46 that forms a portion of the fuel chamber 22.

As mentioned above, the burner ports 24 are distributed over the outer part of the spiral-shaped sidewall 18. Specifically, burner ports 24 are formed in the outer curved wall portion 42 and the cylindrical wall portion 44, but preferably not the inner curved wall portion 40. The spacing between the arm section 38 and the hub section 36 (distance A) is large enough, preferably about one inch, to prevent the flames from the ports 24 on the cylindrical wall portion 44 from impinging on the inner curved wall portion 40. Omitting burner ports from the inner wall portion 40 avoids excessive heat release in the space between the arm section 38 and the hub section 36 and reduces flame let interactions. This arrangement provides a concentration of ports 24 that will be located near the center of a utensil and a distribution of ports 24 across the utensil's radius. Thus, the gas burner 10 provides both an even heat distribution and good heating speed using a single burner body 14.

Preferably, all of the ports 24 are the same size throughout the burner body 14 and are equally spaced. To ensure that the ports 24 nearest to the distal end of the curved arm section 38 are supplied with an adequate amount of the fuel-air mixture introduced in the fuel chamber 22, the channel 46 is provided with a cross-sectional area that is large enough to minimize the pressure drop along its length. However, given their proximity to the mixing tube 26, the burner ports 24 in the hub section 36 could produce oversized flames when the burner 10 is operating on high. To avoid this possibility, an alternative configuration would be to make the ports 24 in the hub section 36 and the proximal region of the arm section 38 smaller than the ports 24 in the rest of the curved arm section 38.

As shown in FIG. 2, the burner body 14 is supported a distance B above the support surface 12 by a plurality of legs 48 arranged around the mixing tube 26. The resultant open space between the burner body 14 and the support surface 12 allows secondary combustion air to flow to the burner ports 24 in the hub section 36, or to any of the ports 24 that face the inner wall portion 40. Accordingly, ample secondary air is available to support maximum combustion in the interior of the burner 10.

In operation, the control knob on the gas cooking appliance that corresponds to the gas burner 10 is operated, thereby opening valve 32 to provide gas to the fuel nozzle 28. The gas is discharged from the injection orifice 34 into the mixing tube 26 and entrains primary air for combustion. The fuel-air mixture flows into the fuel chamber 22 and is discharged through the burner ports 24 for combustion. Combustion is initiated by a conventional igniter, such as a spark ignition electrode (not shown). Preferably, the igniter is located at the junction of the arm section inner wall portion 40 and the hub section 36, adjacent to a first burner port 24*a* (FIG. 1).

Figure 3:
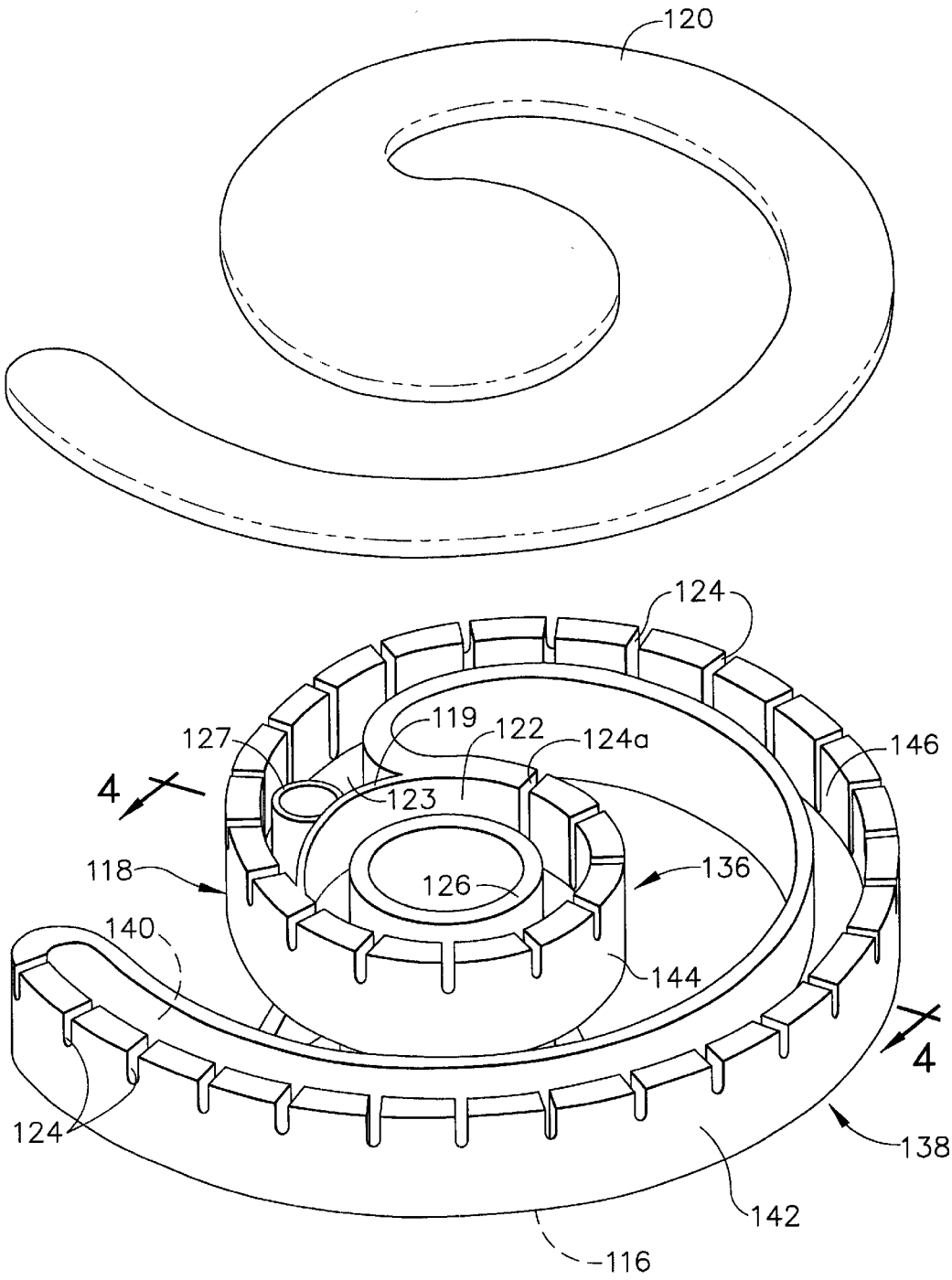
FIG. 3 is an exploded perspective view of a second embodiment of the atmospheric gas burner of the present invention.
Figure 4:
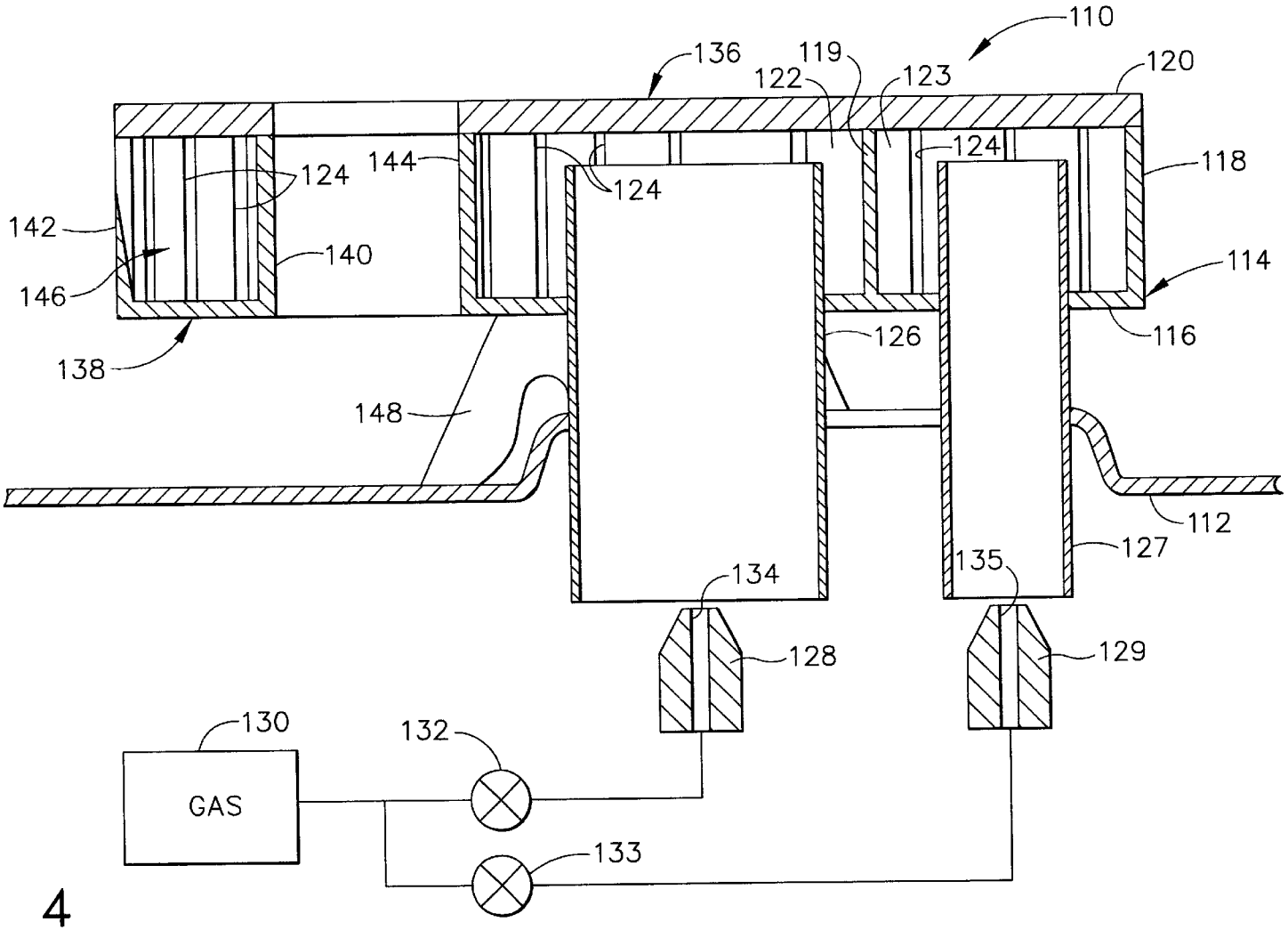
FIG. 4 is a cross-sectional plan view of the gas burner taken along line 4—4 of FIG. 3.

Turning now to FIGS. 3 and 4, a second embodiment of an atmospheric gas burner 110 is illustrated. The gas burner 110 is attached to a support surface 112 that forms a portion of the top side of a gas cooking appliance such as a range or cooktop. As in the first embodiment, the gas burner 110 comprises a spiral-shaped burner body 114 having a spiral-shaped base portion 116 and a sidewall 118 formed along the periphery of the base portion 116 and extending perpendicularly therefrom. A spiral-shaped cap 120 covers the top of the burner body 114, thereby defining an internal chamber within the burner body 114. The cap 120 can either be fixedly attached to the sidewall 118 or can simply rest on the sidewall 118 for easy removal.

The spiral-shaped burner body 114 is made up of a central hub section 136 and a curved arm section 138 contiguously formed with the hub section 136. The curved arm section 138 is joined at one end to the hub section 136 and bends around the hub section 136 in a substantially spiral manner so that its distal end is located a maximum distance from the center of the burner 110. Preferably, the curved arm section 138 is shaped so that a substantial portion of the arm section 138 is at the its maximum distance from the burner center.

Preferably, the curved arm section 138 extends over an arc of approximately 270–320 degrees, although the arc could be less or more than this range. Indeed the curved arm section 138 could comprise multiple turns around the hub section 136.

Although the sidewall 118 is a contiguous wall formed around the periphery of the base portion 116, it is made up of three portions: an inner curved wall 140 and an outer curved wall 142 in the arm section 138 and a substantially cylindrical wall 144 in the hub section 136. An internal wall 119 separates the hub section 136 and the arm section 138 so as to divide the burner body internal chamber into first and second fuel cavities 122 and 123. The interior wall 119 can be curved to generally continue the shape defined by the cylindrical wall 144.

A plurality of burner ports 124 is formed in the outer edge of the sidewall 118. Some of the ports 124 are in fluid communication with the first fuel cavity 122. The remaining ports 124 are in fluid communication with the second fuel cavity 123. Specifically, burner ports 124 are formed in the outer curved wall 142 and the cylindrical wall 144, but preferably not the inner curved wall 140. Preferably, all of the ports 124 are the same size throughout the burner body 114 and are equally spaced. The spacing between the arm section 138 and the hub section 136 is large enough, preferably about one inch, to prevent the flames from the ports 124 on the cylindrical wall 144 from impinging on the inner curved wall 140. Omitting burner ports from the inner wall 140 avoids excessive heat in the space between the arm section 138 and the hub section 136. This arrangement provides a concentration of ports 124 that will be located near the center of a utensil and a distribution of ports 124 across the utensil's radius. Thus, the gas burner 110 of the second embodiment also provides both an even heat distribution and good heating speed using a single burner body 114.

A first mixing tube 126, such as a venturi tube, extends through the support surface 112 and the base portion 116 so as to have a first end located in the first fuel cavity 122 and a second end located externally of the burner body 114 and below the support surface 112. The first mixing tube 126 is preferably centered with respect to the hub section 136. A second mixing tube 127 also extends through the support surface 112 and the base portion 116 so as to have a first end located in the second fuel cavity 123 and a second end located externally of the burner body 114 and below the support surface 112. The second mixing tube 127 is preferably positioned near the junction of the hub section 136 and the arm section 138.

A first fuel nozzle 128 is located approximately concentric with the opening of the first mixing tube 126 and has an injection orifice 134 aligned with the second end of the first mixing tube 126 so that fuel discharged from the injection orifice 134 flows into the first mixing tube 126. Similarly, a second fuel nozzle 129 is located approximately concentric with the opening of the second mixing tube 127 and has an injection orifice 135 aligned with the second end of the second mixing tube 127 so that fuel discharged from the injection orifice 135 flows into the second mixing tube 127. The first fuel nozzle 128 is connected to a source of gas 130 via a first valve 132, and the second fuel nozzle 129 is connected to the source of gas 130 via a second valve 133. Both valves 132 and 133 are jointly controlled in a known manner by a control knob on the gas cooking appliance to regulate the flow of gas from the source 130 to the two fuel nozzles 128 and 129.

The range of operation of the valves 132 and 133 is as follows. When the control knob is turned wide open, the first valve 132 supplies fuel at maximum pressure to the first fuel nozzle 128, and the second valve 133 supplies fuel at maximum pressure to the second fuel nozzle 129. As the knob is turned down, the fuel pressure to the second fuel nozzle 129 is gradually reduced until such point that a minimum sustainable pressure is reached. Over this range, the fuel supplied to the first fuel nozzle 128 from the first valve 132 can either be constant or vary as the knob is turned down. Upon further turndown from the above-mentioned point that a minimum sustainable pressure is reached, the second valve 133 remains closed so that no fuel is supplied to the second fuel nozzle 129, and the fuel pressure to the first fuel nozzle 128 is gradually reduced until the burner 10 is turned off.

Primary air to support combustion is obtained from the ambient space below the support surface 112 and is entrained by the fuel jets in conventional fashion through the open areas around the second ends of the mixing tubes 126 and 127. Thus, the mixing tubes 126 and 127 introduce a fuel-air. mixture into the first and second fuel cavities 122 and 123, respectively. Thus, the fuel-air mixture delivered via the first mixing tube 126 is discharged through the burner ports 124 that are in fluid communication with the first fuel cavity 122, and the fuel-air mixture delivered via the second mixing tube 127 is discharged through the burner ports 124 that are in fluid communication with the second fuel cavity 123. This provides independent operation of the hub section 136 and the arm section 138. As in the first embodiment, combustion is initiated by a conventional igniter (not shown), preferably located adjacent to a first burner port 124*a* (FIG. 3). Combustion is further supported by secondary combustion air drawn from the ambient space around the burner ports 124. Ample secondary air is available because the burner body 114 is supported by a plurality of legs 148 a sufficient distance above the support surface 112 to allow external air flow to the burner ports 124, particularly those ports that face the inner wall portion 140.

The foregoing has described a single body gas burner that provides both an even heat distribution and good heating speed. While specific embodiments of the present invention have been described, it will be apparent to those skilled in the art that various modifications thereto can be made without departing from the spirit and scope of the invention as defined in the appended claims.

What is claimed is:

1. A gas burner comprising:

a spiral-shaped burner body having a hub section having a first inner diameter and including an inlet port for introducing a fuel-air mixture therethrough and a curved arm section having a second inner diameter less than said first inner diameter and joined at one end thereof to said hub section and in fluid communication therewith, said burner body being a continuous, single body having an outer wall and a inner wall contiguous with said outer wall and defining an internal chamber therebetween;

a plurality of first ports formed in said outer wall of said burner body, said ports being in fluid communication with said internal chamber; and a plurality of second ports formed in the inner wall of said hub section, said second ports in fluid communication with said internal chamber of said hub section.

2. The gas burner of claim 1 wherein said arm section extends over an arc in the range of approximately 270–320 degrees.

3. The gas burner of claim 1 further comprising an internal wall separating said hub section and said arm section so as to divide said internal chamber into first and second cavities.

4. The gas burner of claim 3 further comprising a first mixing tube for introducing a fuel-air mixture into said first cavity and a second mixing tube for introducing a fuel-air mixture into said second cavity.

5. The gas burner of claim 1 further comprising means for supporting said burner body a distance above a support surface.

* * * * *